US007175571B1

(12) United States Patent
Rodgers

(10) Patent No.: US 7,175,571 B1
(45) Date of Patent: Feb. 13, 2007

(54) WATERFALL JUMP ROPE

(76) Inventor: Sean L. Rodgers, 10605 Empire Dr., Pacoima, CA (US) 91331

( * ) Notice: Subject to any disclaimer, the term of this patent is extended or adjusted under 35 U.S.C. 154(b) by 0 days.

(21) Appl. No.: 11/274,100

(22) Filed: Nov. 14, 2005

(51) Int. Cl.
*A63B 21/22* (2006.01)

(52) U.S. Cl. ..... 482/81; 482/82

(58) Field of Classification Search ..... 482/81, 482/82; 472/13, 128; 446/307
See application file for complete search history.

(56) References Cited

U.S. PATENT DOCUMENTS 3,107,916 A * 10/1963 Cooper ..... 482/81
3,481,600 A * 12/1969 Rekolt et al. ..... 482/81
3,595,571 A * 7/1971 Spinnett et al. ..... 482/81
4,124,206 A * 11/1978 Price ..... 482/81
5,230,678 A * 7/1993 Kaiser, II ..... 482/82
5,256,120 A * 10/1993 Howell ..... 482/82
5,314,393 A * 5/1994 Rubin et al. ..... 482/82

* cited by examiner

*Primary Examiner*—Stephen R. Crow
*Assistant Examiner*—Allana Lewin

(57) ABSTRACT

A water spraying jump rope which is constructed by a free standing post, a water supply pipe mounted in the free standing post, a flexible hollow tubing having a plurality of orifices spaced at intervals connected to one end of the water supply pipe through a swivel joint, and a swivel joint/grip handle assembly rotatably connected to a free end of the flexible hollow tubing.

9 Claims, 2 Drawing Sheets

WATERFALL JUMP ROPE

FIELD OF THE INVENTION

The present invention generally relates to a sporting or game equipment and more particularly, relates to a waterfall jump rope that combines the sporting fun of both a water spray hose and a jump rope.

BACKGROUND OF THE INVENTION

Jump ropes have been a popular equipment for sport activities for adults and as a game for children. It has been used for many years. The rope jumping activity not only provides a high degree of physical exercise, but also provides a lot of fun and competition. Rope jumping can be performed at very low cost since the only equipment required is a jump rope, which is probably one of the least expensive sporting equipment. However, rope jumping in a warm or hot climate could be too strenuous and exhausting for most people, unless it can be conducted in an air-conditioned environment. Rope jumping, therefore, may not be a popular sporting event or game during the summer time.

A popular sport or game during hot weather is for individuals, especially children, to run through the spray of a lawn sprinkler in order to cool off. Children frequently wet each other with a water spray from a standard garden hose to achieve the same cooling off effect. Cooling off with water spray in hot weather outdoors is fun and inexpensive and therefore is very popular for the general public.

It would be highly desirable if the sport or game of rope jumping and water spraying can be combined together to achieve a both fun and cooling off effect. Currently, there is no such product available in the marketplace, such as in a sporting goods store, that can achieve both desirable effects.

It is therefore an object of the present invention to provide a sporting equipment that allows both rope jumping and water spraying to be achieved at the same time.

It is another object of the present invention to provide a jump rope that would also spray water for cooling off the person who is playing the jump rope.

It is yet another object of the present invention to provide a sporting equipment that can be used as a jump rope while spraying a water mist at the same time to cool off the person who is rope jumping.

It is yet another further object of the present invention to provide a waterfall jump rope that can be used both by adults and children in sports or playing.

SUMMARY OF THE INVENTION

In accordance with the present invention, a water spraying jump rope that combines the sporting activity of both rope jumping and running through a lawn sprinkler can be achieved in one activity.

In a preferred embodiment, the water spraying jump rope is constructed including a free standing post for supporting a water supply pipe, the water supply pipe has a first end for sealingly connecting to a water supply and a second end equipped with a first swivel joint that provides water-tight rotational seal to a flexible hollow tubing; a flexible hollow tubing that has a first end sealingly connected to the first swivel joint and a second end sealingly connected to a second swivel joint/grip handle assembly, the flexible hollow tubing has a plurality of orifices spaced at intervals along an inner circumferential surface when the flexible hollow tubing is swung to encircle a rope jumper; and a swivel joint/grip handle assembly for holding by a player and for swinging the flexible hollow tubing around the rope jumper.

BRIEF DESCRIPTION OF THE DRAWINGS

The invention will now be described, by way of example, with reference to the accompanying drawings, in which.

DETAILED DESCRIPTION OF THE INVENTION

The present invention provides a waterfall jump rope, or a water spraying jump rope that is constructed by a free standing post, a water supply pipe mounted in the post, a flexible hollow tubing that is rotatably connected to the water supply pipe, and a swivel joint/grip handle assembly that is rotatably connected to a free end of the flexible hollow tubing.

The present invention water spraying jump rope provides relief in hot weather when a person performs rope jumping as an exercise or just for fun. The flexible hollow tubing features a series of holes, or orifices that are spaced at intervals to allow passage of water. When water is turned on at a sufficient pressure, a water spray or mist is formed from the plurality of orifices to spray on the rope jumper and thus performing the cooling off effect. One end of the flexible hollow tubing is connected to a water supply pipe with a swivel joint to allow the flexible hollow tubing to be rotated freely at the swivel joint. The other end of the water supply pipe is connected to an outdoor faucet for receiving a water supply when the faucet is turned on. The water supply pipe can be mounted in a free standing post that is staked into the ground. The mounting position of the water supply pipe can be suitably adjusted through apertures provided in the free standing post in order to accommodate the height of different rope jumpers.

When water supply is turned on, water passes through the flexible hollow tubing and sprays out of the plurality of orifices. A player can use the flexible hollow tubing as a conventional jump rope, by swinging the flexible hollow tubing under their feet and over their head. The present invention water spraying jump rope can be produced in different sizes and different colors. It can be used by any user that is older than six or seven years old.

The present invention water spraying jump rope provides the appealing features of its entertainment value, ease in use, and reasonable cost. It can be made as one of the least expensive sporting equipment. The water spraying jump rope provides hours of fun-field water entertainment for children or adults alike. It encourages exercise in a hot summer day where a person will not likely exercise otherwise.

Figure 1:
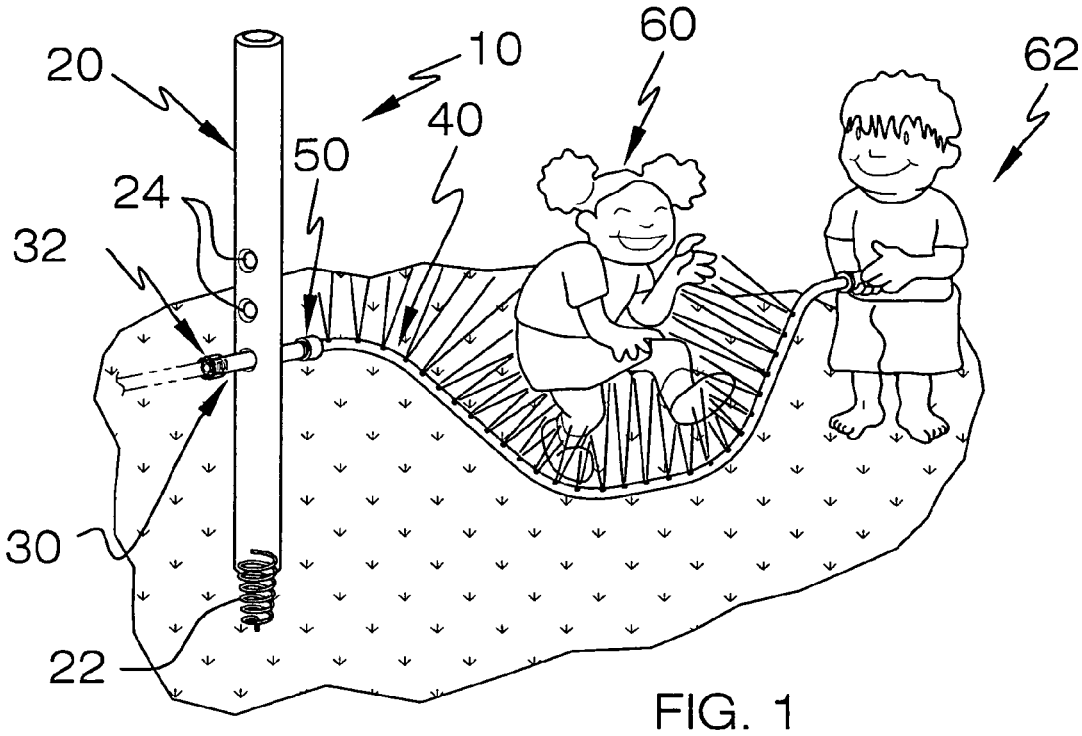
FIG. 1 is a perspective view of the present invention waterfall jump rope in use by a rope jumper.
Figure 2:
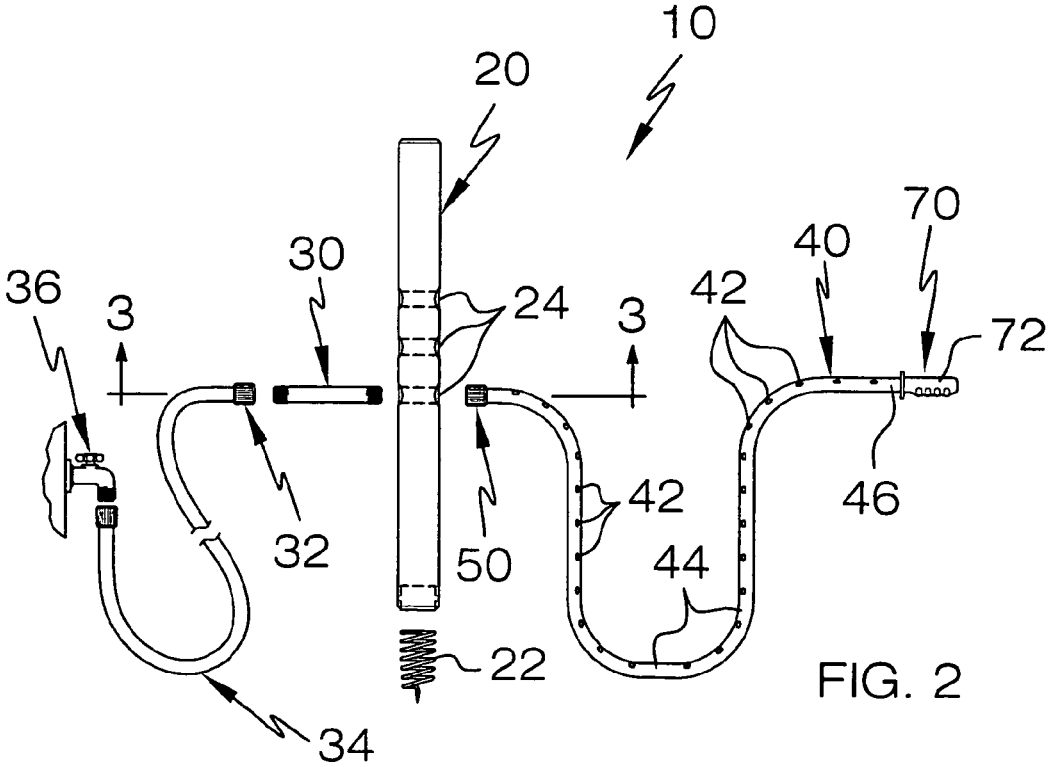
FIG. 2 is an plane view of the present invention waterfall jump rope system.
Figure 3:
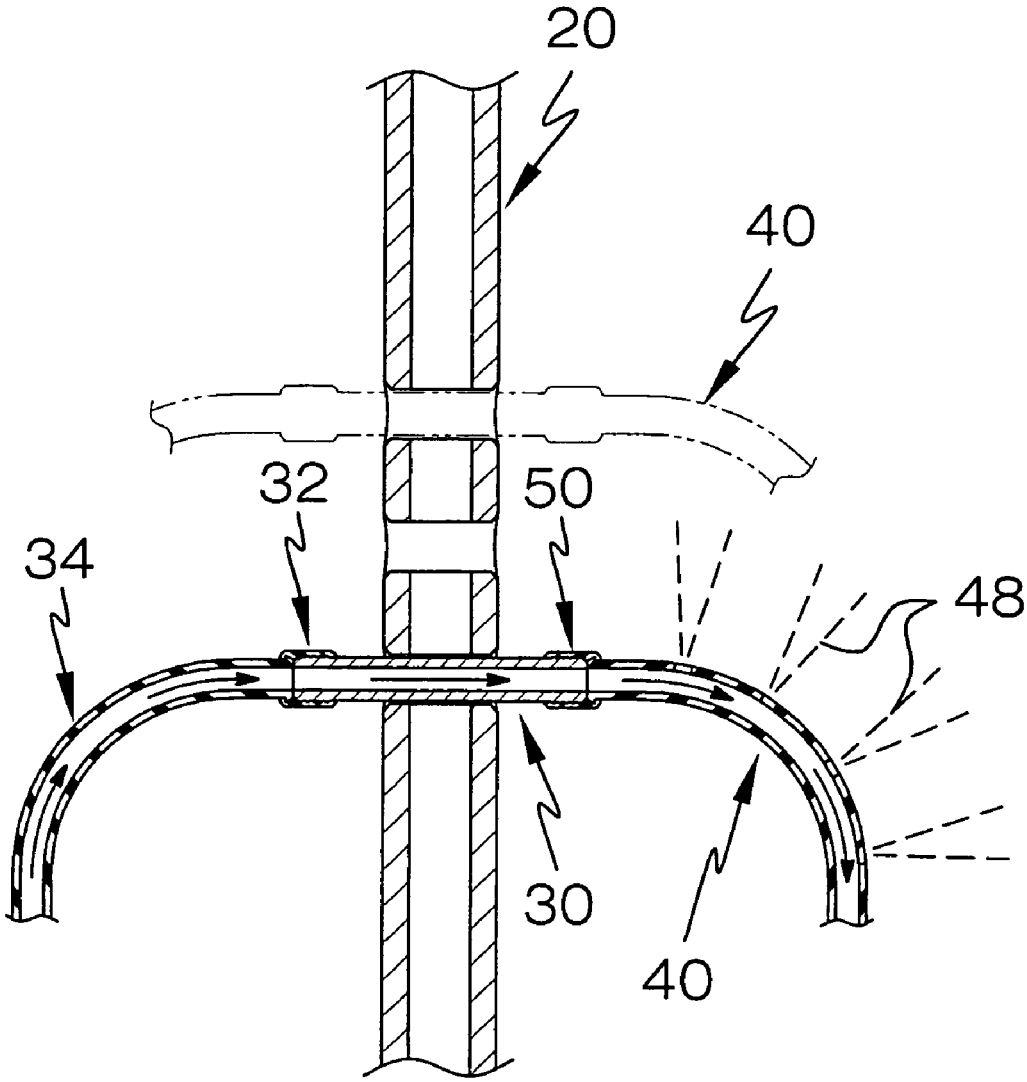
FIG. 3 is an enlarged, cross-sectional view showing the present invention free standing post, water supply pipe, and the flexible hollow tubing.

Referring initially to FIG. 1, wherein a present invention water spraying jump rope 10 is shown in use. The water spraying jump rope 10 is constructed by the major components of a free standing post 20 which is equipped with a coil 22 at the bottom for staking into the ground. Instead of the coil 22, any suitable staking device such as a sharp pointed stake may also be used. The free standing post 20 is provided with a plurality of apertures 24 for the mounting of a water supply pipe 30. Depending on the height of the rope jumper, a suitable apertures 24 can be selected for mounting the water supply pipe 30. For mounting of the flexible hollow tubing 40, a swivel joint 50 is used to provide water-tight rotating seal. At the opposite end of the water supply pipe 30, a conventional water-tight coupling 32 may be used for connecting a length of a water supply hose 34 to provide water supply from faucet 36. The free standing post 20 may be fabricated of a plastic material, while the flexible hollow tubing 40 may be formed of a flexible plastic material, or a clear plastic, or a colored plastic. The flexible hollow tubing 40 may have an outside diameter of at least ½ inch. The swivel joint/grip handle assembly 70 may also be fabricated of a plastic material.

In the flexible hollow tubing 40, a plurality of orifices 42 are provided which are spaced at predetermined intervals along an inner circumferential surface 44 when the flexible tubing is swung to encircle a rope jumper 60. A swivel joint/grip handle assembly 70 is provided at the free end 46 of the flexible hollow tubing 40 which again provides a swivel joint for a water-tight rotating seal when the grip handle 72 is held and swung by a second player 62. Since the plurality of orifices 42 is formed on the inner circumferential surface 44 of the flexible hollow tubing 40, the water spray 48 is always aimed at the rope jumper, as shown in FIG. 1. Each of the plurality of orifices 42 may have an inside diameter of at least 1/32 inch.

While the preferred embodiment of the invention have been described above, it will be recognized and understood that various modifications can be made in the invention and the appended claims are intended to cover all such modifications which may fall within the spirit and scope of the invention.

What is claimed is:

1. A water spraying jump rope comprising:

a free standing post for supporting a water supply pipe; said water supply pipe having a first end for sealingly connecting to a water supply and a second end for connection to a first swivel joint that provides water-tight rotatable seal to a flexible hollow tubing, said free standing post having at least three apertures therethrough for mounting said water supply pipe at at least three different heights;

a flexible hollow tubing having a first end sealingly connected to said first swivel joint and a second end sealingly connected to a second swivel joint/grip handle assembly, said flexible hollow tubing having a plurality of orifices spaced at intervals along an inner circumferential surface when said flexible hollow tubing being swung to encircle a rope jumper; and a swivel joint/grip handle assembly for holding by a player and swinging said flexible hollow tubing around said rope jumper.

2. The water spraying jump rope according to claim 1, wherein said free standing post is formed of a plastic.

3. The water spraying jump rope according to claim 1, wherein said water pipe being provided with a coupling for connecting to a water supply hose at one end.

4. The water spraying jump rope according to claim 1, wherein said flexible hollow tubing is formed of a flexible plastic material.

5. The water spraying jump rope according to claim 1, wherein said hollow tubing being formed of a clear plastic.

6. The water spraying jump rope according to claim 1, wherein said flexible hollow tubing being formed of a colored plastic.

7. The water spraying jump rope according to claim 1, wherein said flexible hollow tubing having an outside diameter of at least ½ inch.

8. The water spraying jump rope according to claim 1, wherein each of said plurality of orifices having an inside diameter of at least *frax*;1;32 *inch*.

9. The water spraying jump rope according to claim 1, wherein said swivel joint/grip handle assembly is formed of a plastic.

* * * * *